United States Patent [19]

Doerr et al.

[11] Patent Number: 4,576,638

[45] Date of Patent: Mar. 18, 1986

[54] PROCESS FOR THE PRODUCTION OF FERROMANGANESE

[75] Inventors: Hermann Doerr, Muelheim; Thomas Hoster; Dieter Neuschuetz, both of Essen; Dietrich Radke, Ratingen; Wilhelm Janssen, Muelheim; Klaus Ulrich, Heiligenhaus, all of Fed. Rep. of Germany

[73] Assignee: Fried. Krupp Gesellschaft mit beschraenkter Haftung, Fed. Rep. of Germany

[21] Appl. No.: 684,324

[22] Filed: Dec. 20, 1984

[30] Foreign Application Priority Data

Dec. 31, 1983 [DE] Fed. Rep. of Germany ..... 3347685

[51] Int. Cl.[4] ..... C22B 47/00

[52] U.S. Cl. ..... 75/80; 75/123 N; 75/133.5; 420/434; 420/581

[58] Field of Search ..... 75/80, 133.5, 123 N; 420/434, 581

[56] References Cited

U.S. PATENT DOCUMENTS

| | | | |
|---|---|---|---|
| 2,549,994 | 4/1951 | Udy | 75/133.5 |
| 3,037,856 | 6/1962 | Udy | 75/80 |
| 3,984,232 | 10/1976 | Bell et al. | 75/80 |

FOREIGN PATENT DOCUMENTS

| | | | |
|---|---|---|---|
| 1014137 | 10/1953 | Fed. Rep. of Germany . | |
| 7101687 | 10/1971 | Japan | 75/80 |
| 1316802 | 5/1970 | United Kingdom . | |
| 425956 | 10/1974 | U.S.S.R. | 75/80 |

*Primary Examiner*—Melvyn J. Andrews
*Attorney, Agent, or Firm*—Sughrue, Mion, Zinn, Macpeak, and Seas

[57] ABSTRACT

A process for the production of ferromanganese from iron-containing manganese ores, in which the reduction of the ore, which is mixed with coal and slag-forming constituents, is conducted in a rotary kiln at 1200° to 1350° C. in the presence of a CO-containing atmosphere for 20 to 240 minutes, and in which melting follows in a melting furnace at 1400° to 1600° C. By this process, the greatest part of the gangue of manganese ore can be separated off before melting the reduced ore.

20 Claims, 1 Drawing Figure

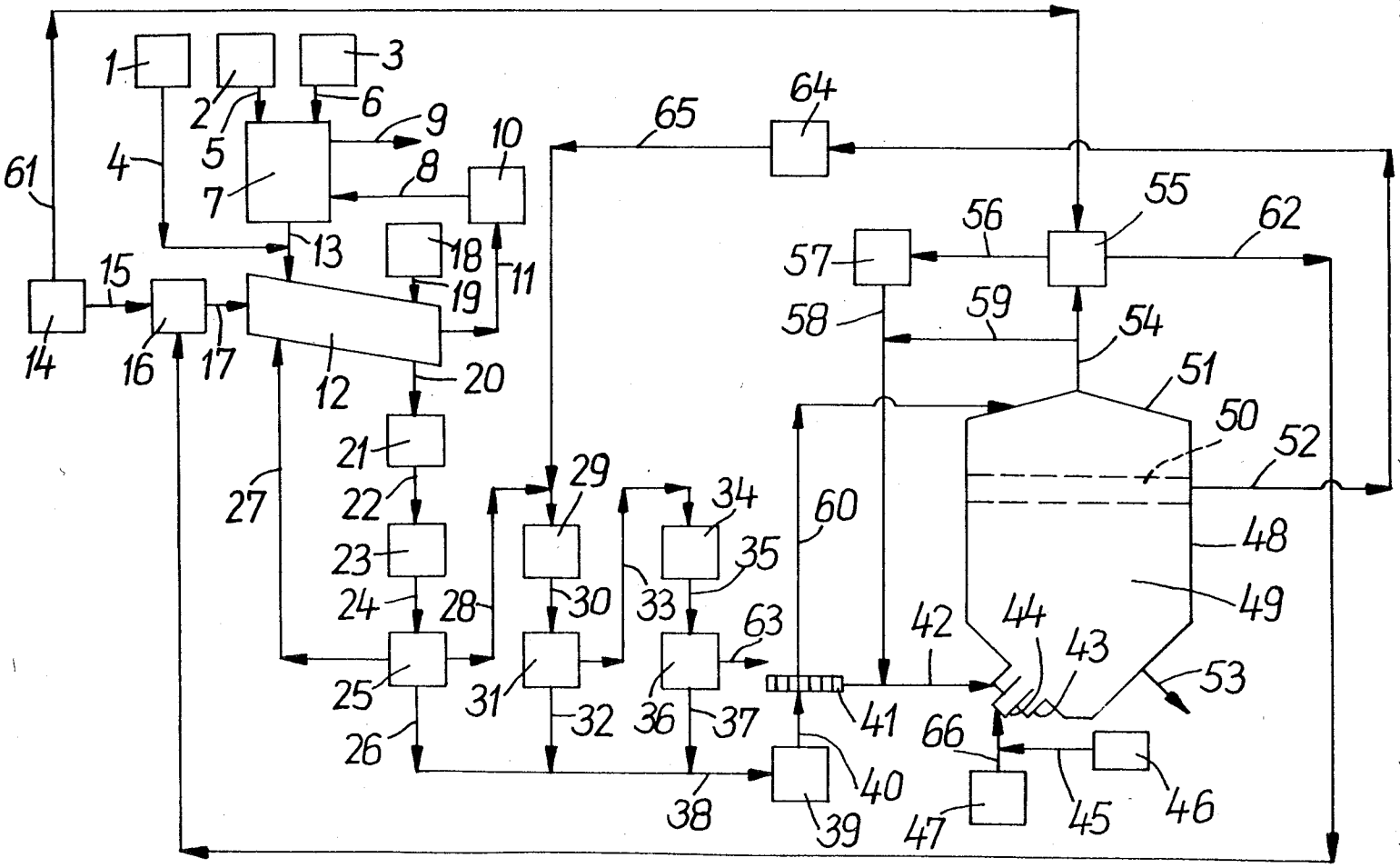
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66

PROCESS FOR THE PRODUCTION OF FERROMANGANESE

BACKGROUND OF THE INVENTION

The present invention relates to a process for production for ferromanganese having a carbon content of 0.05 to 8% from iron-containing maganese ore by heating a mixture of maganese ore, solid carbon-containing fuel and slag-forming constituents in a rotary kiln to form a reaction product, and subsequently melting ferromanganese from the reaction product which is removed from the rotary kiln and cooled down before the melting.

Ferromanganese is an alloy which contains or consists of 30 to 95% manganese, 0.05 to 8% carbon, up to 1.5% silicon, up to 0.3% phosphorous and the rest iron. Ferromanganese is used principally as a deoxidation agent in steel production, as well as for the production of manganese steels. Ferromanganese is obtained from a mixture of coke, manganese- and iron-ores in a blast furnace or in an electrically heated furnace, particularly in a submerged arc furnace. The manganese-ores containing iron, such as, for example, manganese modules, contain 10 to 50% manganese and up to 30% iron, wherein manganese can be present as $MnO_2$, $Mn_2O_3$, MnO(OH), $Mn_3O_4$ as well as $MnCO_3$, and iron can be present as $Fe_2O_3$ as well as $(Mn, Fe)_2O_3$. It is difficult to even partially separate the gangue before melting the ore, so that a high portion of gangue in the known melt-reduction process must be separated as liquid slag from the produced ferromanganese alloys, which usually is possible only at temperatures more than 1600° C. and therefore causes an undesirably high use of energy.

A process for the production of ferromanganese is known from British Pat. No. 1,316,802 by which a mixture of coal, slag-forming constitutents and manganese, the gangue of which contains $SiO_2$ and $Al_2O_3$, is heated in a cylindrical rotary kiln at temperatures of 1300° C. to form a reaction product, and subsequently the reaction product is removed from the cylindrical rotary kiln and is melted in an electric furnace, whereby ferromanganese is obtained. A considerable disadvantage with this process is that the whole throughput of the cylindrical rotary kiln, including the coal, reaches the melting furnace, and considerable reduction must be accomplished in the melting furnace, because the reduction in the cylindrical rotary kiln is carried out to MnO. In the electric furnace, silicon is used as the reduction agent, which is added as an alloy.

German Auslegeschrift No. 1,014,137 discloses a process for the melting of iron-poor ore in a cylindrical rotary kiln, in which the pulverized ore is mixed with fuel and is heated to temperatures from 1100° to 1300° C., wherein the ore is reduced to metallic iron and magnetic iron oxide compounds, and in which subsequently the magnetic components of the reaction product are separated from the gangue by magnetic separation. Neither British Pat. No. 1,316,802 nor German Auslegeschrift No. 1,104,137 teach how a separation of the gangue can be achieved before melting the ferromanganese without causing work stoppages in the cylindrical rotary kiln and without requiring reduction in the melting furnace.

SUMMARY OF THE INVENTION

A primary object of the present invention is to provide a process for the production of ferromanganese, which enables the reduction- and melting-processes to be conducted at lower temperatures, thereby achieving a considerable saving of energy.

In particular, it is an object of the present invention to provide a melting process which is able to work at a temperature under 1600° C., and to provide a process in which there is a separation of the predominant part of the gangue of the ore before the melting of the reduced ore without melting the gangue.

A further object of the present invention is to provide such a process in which the raw materials, namely, manganese ore, coal and slag-forming constituents can be added without an expensive pre-treatment, and in which a reoxidation of the reduced manganese ore is prevented.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for producing ferromanganese with a carbon content of from 0.05 to 8% from iron-containing manganese ores by heating a mixture of manganese ore, solid carbon-containing fuel and slag-forming constituents in a rotary kiln and subsequently melting ferromanganese from the reaction product that is removed from the rotary kiln and cooled down, comprising (a) forming a mixture of manganese ore, coal and slag-forming constituents at an ore-coal ratio of 1:0.4 to 1:2, with slag-forming constituents originated from the ore and the coal such as CaO, MgO, $Al_2O_3$ and $SiO_2$, with separate slag-forming constituents CaO and/or MgO and/or $Al_2O_3$ and/or $SiO_2$ being added to the mixture if necessary in such a quantity that in the final slag including the constituents of the ore, the coal and the added fluxes a $(CaO+MgO)/(Al_2O_3+SiO_2)$ ratio exists of 1:03 to 1:4 and the $Al_2O_3/SiO_2$ ratio amounts to 1:0.3 to 1:9; (b) heating the mixture in the rotary kiln for 20 to 240 minutes in a CO-containing atmosphere at temperatures of 1200° to 1350° C. to form a reaction product and removing the reaction product from the rotary kiln; (c) crushing the reaction product, removed from the rotary kiln, to a particle diameter of less than 15 mm; (d) separating the crushing reaction product by density separation into a coal-containing fraction which is reintroduced into the rotary kiln, at least one metal-containing slag-rich fraction and an alloy fraction to be delivered to a melting furnace; and (e) melting the alloy fraction in the melting furnace at temperatures from 1400° to 1600° C.

Surprisingly, it has been found that in the process of the present invention carried out in a rotary kiln, which can be a cylindrical rotary kiln or a rotary drum kiln, a reduction degree of 90 to 98% with respect to manganese and iron is achieved. When the mixture of ore, coal and slag-forming constituents is transformed during the reduction into a plastic state wherein an agglomeration of single metallic particles and small metallic droplets takes place. A noticeable reoxidation of the metal particles does not occur, because the metal droplets imbedded in the reduction material, unlike those in the known direct reduction processes in which the original structure of the ore is maintained, have a comparatively small surface.

It is additionally surprising that during the reduction, practically no manganese carbide is formed, by rather that a ferromanganese alloy is formed. The melting of the reduced material from the rotary kiln occurs in a suitable melting furnace, after cooling and separating from the reduced material the rest of the coal and part of the gangue. Through the ore-coal ratio in the manganese ore-coal-slag-forming constituents mixture according to the present invention, an optimum reduction process is achieved in the rotary kiln, and an optimum melting process is achieved in the melting furnace. By the $(CaO+MgO)/(Al_2O_3+SiO_2)$ ratio and the $Al_2O_3/SiO_2$ ratio of the slag, the raw material mixture in the rotary kiln is transformed especially quickly into the plastic state. The CaO, MgO, $Al_2O_3$ and $SiO_2$ content of the manganese ore, as well as the ashes of the coal, should be considered for proportioning the amount of the slag-forming constituents. By the crushing of the reduced material taken out of the rotary kiln, and the density separation of the crushed reduced material, it is possible to gain for the subsequent melting operation a fraction which is rich in ferromanganese alloy and to separate coal and part of the gangue.

BRIEF DESCRIPTION OF THE DRAWINGS

The sole FIGURE of the drawing illustrates a typical flow chart of a preferred embodiment of the process according to the present invention.

DETAILED DESCRIPTION OF THE INVENTION

The process according to the present invention can be especially successfully carried out, when the mixture of manganese ore, coal and slag-forming constituents is heated in the rotary kiln for a period of 20 to 120 minutes at temperatures of 1250° to 1330° C., and the melting of the alloy fraction is carried out at temperatures of 1450° to 1550° C.

Preferably, according to the present invention, in the manganese ore-coal-slag-forming constituents mixture, the manganese ore has a particle diameter under 5 mm, the coal a particle diameter under 15 mm, and the slag-forming constituents a particle diameter under 5 mm. With a composition of the raw material mixture of this kind, it is not necessary to granulate or to pelletize the raw materials before their introduction into the rotary kiln, because by charging the raw materials with the particle size, as is done according to the present invention, surprisingly no disturbance in the rotary kiln is observed during the reduction process. Of course, it is also possible to charge the rotary kiln with a granulated or pelletized raw material mixture. It is also preferred, according to the present invention, that $SiO_2$ is first added to the manganese ore-coal-slag-forming constituents mixture in the rotary kiln when the mixture has a temperature of more than 900° C. By so doing, the formation of low melting slag components of FeO, MnO and $SiO_2$ is advantageously avoided.

In a further embodiment of the present invention, each metal-containing slag-rich fraction is crushed to a particle diameter of less than 5 mm, and is separated by density separation into a metal-poor slag and an alloy fraction to be delivered into the melting furnace. The preparation step raises the yield of the ferromanganese produced.

Additionally, in a further preferred embodiment of the present invention, the metal-poor slag fractions are ground to a particle diameter of less than 0.5 mm, and by density separation and/or electrostatic separation are separated into a slag fraction and an alloy fraction to be delivered into the melting furnace. The yield of the ferromanganese produced is increased even more by this preparation step as well.

The above referred to density separations according to the process of the present invention work preferably with gaseous, dry separation media, because a reoxidation of the metal would occur with the use of an aqueous separation medium. The density separation can, however, also be carried out by the use of a non-oxidizing liquid as a liquid separation medium, e.g., oil or an organic solvent.

It is preferred according to the present invention that the portion of the alloy fraction with a particle diameter under 1 mm is blown into the melt in the melting furnace. This can occur either from above or below the metal bath surface. Uniform melt-down is achieved by the injection of a portion of the alloy fraction into the melt. The portion of the alloy fraction with a diameter above 1 mm is charged from above in the melting furnace.

According to the present invention, it is especially advantageous when the portion of the alloy fraction with a particle diameter $<1$ mm as well as coal with a particle diameter $<1$ mm are suspended in a carrier gas and are blown into the melt through a first nozzle provided in the melting furnace underneath the metal bath surface, while oxygen is introduced into the melt through a second nozzle coordinated with the first nozzle. By the common injection of these materials, uniform melt-down is achieved with the optimum intermixture of the melt and the slag.

In a further embodiment of the present invention, the alloy fraction-coal-carrier gas suspension is blown into the melt through the outer tube of a jacket nozzle arranged underneath the metal bath surface in the melting furnace, and oxygen is blown into the melt through the inner tube of the jacket nozzle. The jacket nozzle has been especially successful for introducing the different materials into the melting furnace.

In a further development of the present invention, 0.4 to 0.8 kg coal, and a stoichiometric quantity of oxygen corresponding to the quantity of coal (with respect to the oxidation product CO) are blown into the melt underneath the metal bath surface. At these ratios, a sufficiently large amount of melting heat is produced in the melting furnace, whereby an overly large coal content is prevented in the melt. The economy of the process according to the present invention is increased, by using at least a portion of the exhaust gas of the melting furnace as a carrier gas for the portion of the alloy fraction as well as for the fine-grained coal, which are blown into the melt. However, other inert gases, particularly nitrogen, can also be used as a carrier gas.

According to the present invention, it is preferred that the heat of the exhaust gases from the melting furnace will be used for the carbonization of coal that is blown into the melt under the surface of the metal bath. By this means, the volatile components contained in the coal are driven off, so that a low-temperature coke is produced. The low-temperature coke, compared with the uncarbonized coal, has a greater usable heat content, which is advantageous for the progress of the melting process. For the energy balance of the process according to the present invention, it has proved to be particularly advantageous, if the exhaust gas from the melting furnace that is not used as a carrier gas and the carbonization gas produced from the carbonization of the coal are burned in the rotary kiln. According to the present invention, it has also been demonstrated to be advantageous if the exhaust gas from the rotary kiln is afterburned, and at least part of the heat content of the afterburned exhaust gas is used to preheat the manganese ore and the slag-forming constituents. The reduction time according to the present invention does not include the preheating time.

In a further embodiment of the present invention, the melt is batchwise refined by the injection of oxygen as well as desulfurized by the addition of CaO and/or $CaC_2$. The refining and desulfurizing can take place either in the melting furnace itself or in an auxiliary second melting vessel. The CaO or $CaC_2$, respectively, can be suspended in a nitrogen stream that is blown into the melt through the inner tube of the jacket nozzle. Through refining and desulfurizing, the carbon content can be reduced to 0.05% and the sulfur content can be reduced to 0.03%. During the refining, the temperature of the melt increases to more than 1600° C.

Finally, it is preferred according to the present invention that the melted slag obtained in the melting furnace is cooled, pulverized and mixed with the metal-containing slag-rich fraction. By this means, it is advantageously achieved that the metal portions present in the melted slag can be recovered.

Referring now to the drawing, which illustrates a typical flow chart of the process according to the present invention, there is shown a bin 2 which contains iron-containing manganese ore or a mixture of iron and manganese ores, respectively, that have a particle size of <5 mm. The ore or ores in bin 2 are conveyed through a pipe 5 into a countercurrent heat exchanger 7. Slag-forming constituents CaO, MgO and $Al_2O_3$ that have a particle size of <5 mm are conveyed from a bin 3 through a pipe 6 into countercurrent heat exchanger 7. In countercurrent heat exchanger 7, the ore-slag-forming constituents mixture is preheated to temperatures up to 800° C. Countercurrent heat exchanger 7 is operated with hot exhaust gases which are conducted into countercurrent heat exchanger 7 through pipe 8. The cooled-down gases are drawn off from countercurrent heat exchanger 7 through a pipe 9 and released into the atmosphere after dust removal (not shown in the drawing). The preheated raw materials in countercurrent heat exchanger 7 are conveyed to a cylindrical rotary kiln 12 through a pipe 13. Moreover, coal that has a particle size of <15 mm is delivered from a bin 1 to cylindrical rotary kiln 12 through a pipe 4.

Cylindrical rotary kiln 12 is heated by burning fine-grained coal that is delivered from a bin 14 through a pipe 15 to a burner 16, and from there through a pipe 17 into cylindrical rotary kiln 12. Cylindrical rotary kiln 12 is preferably heated in countercurrent to the preheated raw materials and the coal; this can, however, also take place in co-current flow, as is illustrated in the drawing. In cylindrical rotary kiln 12, a temperature preferably of 1250° to 1330° C. is maintained within the reduction zone, and the reduction material assumes a plastic state under reduction conditions, in which small metal droplets are formed and several particles of the reduction material agglomerate. Certainly, in cylindrical rotary kiln 12, no separation of the metallic phase and the gangue occurs, and the plastic condition of the reduction material does not lead to baking on in cylindrical rotary kiln 12. The baking on can in particular be prevented by providing the cylindrical rotary kiln with a magnesite lining that contains additions of chromium oxide and/or coal and/or tar.

In the zone of rotary kiln 12, in which the reduction material has a temperature of more than 900° C., $SiO_2$, required for slag formation, which has a particle size of <5 mm, is introduced from a bin 18 through a pipe 19. Into cylindrical rotary kiln 12, with regard to the $SiO_2$-content of coal from bin 18, only so much $SiO_2$ is introduced as is necessary to produce a plastic condition. The CO-containing exhaust gas is conducted from rotary kiln 12 through a pipe 11 to a combustion chamber 10, where is is afterburned.

The discharge from the rotary kiln 12 arrives through a pipe 20 into a cooling drum 21, where it is cooled off. The cooled throughput of cylindrical rotary kiln 12 then arrives through a pipe 22 into a crusher 23, where a pulverization to a particle diameter of <15 mm results. Subsequently, the pulverized throughput of cylindrical rotary kiln 12 is conducted through a pipe 24 into a pneumatic concentrating table 25, in which a separation into a coal-containing fraction, a metal-containing slag-rich fraction, and metal-rich alloy fraction occurs. The coal-containing fraction is conducted through a pipe 27 into cylindrical rotary kiln 12, while the metal-rich alloy fraction is conducted to a bin 39 through pipes 26 and 38.

The metal-containing slag-rich fraction is conducted through a pipe 28 to a grinder 29, where pulverization to a particle diameter of <5 mm occurs. The pulverized material from grinder 29 then arrives through a pipe 30 into a pneumatic concentrating table 31, in which the mixture is separated according to its different densities into an alloy fraction and a metal-poor slag fraction. The alloy fraction arrives through pipes 32 and 38 into bin 39, while the metal-poor slag fraction is conducted through a pipe 33 into a grinder 34, where pulverization to a particle diameter of <0.5 mm takes place. Subsequently, the pulverized metal-poor slag fraction from grinder 34 arrives through a pipe 35 into a pneumatic concentrating table 36, where a separation into an alloy fraction and a slag fraction occurs. The alloy fraction is conducted through pipes 37 and 38 into bin 39, while the slag fraction, that now contains only a very small portion of metals, is carried off through a pipe 63 and deposited on a dump.

The individual metal containing alloy fractions are mixed in bin 39 and arrive through a pipe 40 at a vibrating screen 41, where the grain fraction with a particle diameter of <1 mm is separated. The grain fraction with a particle diameter of >1 mm is introduced into a melting furnace through a pipe 60 and an exhaust gas hood 51. The grain fraction with a particle diameter of <1 mm, on the other hand, comes into melting furnace 48 through a pipe 42 and the outer tube 43 of a cap jet. In melting furnace 48 is the melt 49 comprised of the ferromanganese alloy, which is removed from the melting furnace in portions at given intervals through an outlet 53. A liquid slag 50 floats on melt 49, and is removed at given intervals from melting furnace 48 through an outlet 52. The liquid slag is conducted into a water trough 64 and cooled there, whereby a granulated material results that reaches grinder 29 through a pipe 45.

The exhaust gas of melting furnace 49 accumulated in exhaust gas hood 51 is used in part as carrier gas and is reintroduced into the melt 49 through pipes 59, 58 and 42 as well as through outer tube 43 of the jacket nozzle. Through the inner tube 44 of the nozzle, oxygen from the storage tank 47 is blown through a pipe 66 into melt 49, to which CaO can be added through a pipe 45, which is contained in a storage vessel 46 and has a particle size of <1 mm.

A portion of the exhaust gas from melting furnace 48 arrives through a pipe 54 into a carbonization apparatus 55, to which coal with a particle size of <1 mm from bin 14 is delivered through a pipe 61. The carbonization gas and the exhaust gas from melting furnace 48 leave the carbonization apparatus 55 through a pipe 62 and are subsequently burned in burner 16. The low-temperature coke leaves the carbonization apparatus through a pipe 56 and is stored in a bin 57. From there, the low-temperature coke is suspended in the carrier gas passing through pipe 59, and through pipes 58 and 42 together with the alloy fraction is blown into the metal melt 49, where the melting process proceeds.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE

To produce a ferromanganese alloy, an iron-containing manganese ore with the following composition is used: 43% Mn, 6.2% Fe, 2.2% MgO, 4.9% $SiO_2$, 0.85% $Al_2O_3$, 10.7% CaO, 10.3% $CO_2$. The ore is pulverized to a particle diameter of <2 mm. The water-free coal used for reduction has the following composition: 18.8% ash, 73.6% carbon, 3.2% hydrogen, 1.5% nitrogen. The coal is pulverized to a particle size of <15 mm. The ash of the coal used contains the following major components: 52% $SiO_2$, 30% $Al_2O_3$, 5% CaO and 2% MgO. A rotary drum furnace is charged with 350 kg of pulverized ore and 350 kg of pulverized coal. The ore-coal ratio thus amounts to 1:1.

The rotary drum furnace has a lining of chromium magnesite and is preheated before charging with the ore-coal mixture to a temperature of 1400° C. A coal dust-oxygen burner is used to heat the furnace, which is operated with 4 kg of fine coal per minute. In addition, air is introduced into the furnace, so that the exhaust gas from the rotary drum furnace contains 25 vol. % $CO_2$ and 12 vol. % CO. The ore-coal mixture remains 60 minutes at 1300° C. in the rotary drum furnace. In the present case, it is not necessary to place slag-forming constituents in the rotary drum furnace because of the composition of the ore and the coal.

The throughput of the rotary furnace is discharged into a cooling drum, and by stirring in water is quickly cooled to temperatures <100° C. The throughput contains 30% particles with a particle diameter <20 mm and 60% particles with a particle size <10 mm. Visible spherical metal particles are firmly embedded in the throughput. The throughput is subsequently pulverized to a particle diameter of <10 mm, and by a dry density separation on a pneumatic concentrating table is separated into a metal-containing fraction (60%) and a coal-containing fraction (40%). The metal-containing fraction is pulverized to a particle diameter of <2 mm. The pulverized metal-containing fraction consists to about $\frac{1}{3}$ of particles that have a diameter of <0.3 mm and a metal content of about 80%. This fine-grained portion is separated and is added to the alloy fraction. Afterwards, the remainder of the metal-containing fraction is separated by dry density separation into a metal-poor slag fraction and a metal-rich alloy fraction. The metal-rich alloy fraction consists of up to 90% of the ferromanganese alloy and up to 10% slag. The metal-poor slag fraction still contains a remainder of ferromanganese alloy that must be separated. From the slag fraction with a particle diameter of from 0.3 to 2 mm, after grinding to a particle diameter of <0.3 mm, a metal-rich part-fraction is separated by electrostatic separation, which is mixed with the metal-rich alloy fraction. The manganese loss that occurs due to the manganese content of the metal-poor slag collected in the density separation amounts to about 7%.

The alloy fraction is melted in a crucible that has a capacity of 3 tons and in which is contained 1200 kg of a metal bath having a temperature of about 1550° C. Through the outer tubes of the jacket nozzle provided in the bottom of the crucible, 8 kg of fine coal per minute are blown into the melt. Through the inner tubes of the jacket nozzle, 6 $Nm^3$ of oxygen per minute are introduced into the melt. In the molten metal, a carbon content of from 3 to 6% is maintained. The fine grained portion of the metal-rich alloy fraction with a particle size of <0.5 mm is blown into the melt together with the coal, while the remainder of the metal-rich alloy fraction is charged in the crucible through the exhaust gas hood. The slag in the crucible has a $(CaO+MgO)/(SiO_2+Al_2O_3)$ ratio of 1:1.9 and an $Al_2O_3$—$SiO_2$ ratio of 1:2.2. The slag is in a fluid state at melting temperature and is drawn off after melting 1000 kg of metal.

After removal of the slag, the addition of coal into the melt is reduced to 4 kg per minute and the temperature of the metal bath is raised to 1750° C. With this procedure, the carbon content of the melt is reduced to about 2%. Subsequently, 8 kg of CaO per minute that is suspended in nitrogen is blown through the inner tube of the jacket nozzle. By this means, the sulfur content of the melt is reduced to a value of < 0.03%. The metal removed from the crucible has a composition of 82% manganese, 12% iron and 2% carbon.

Into the exhaust gas from the crucible are blown in 8 kg per minute of fine coal. The exhaust gas is thus cooled to 600° to 700° C., and the volatile components of the coal are expelled. The gas mixture of the carbonization gas and the cooled exhaust gas from the melting vessel is burned. The low-temperature coke obtained in the carbonization is ground and blown into the vessel through the outer tubes of the jacket nozzle.

The iron and manganese yield that was reached carrying out the procedure according to the example, is about 90%. The process conditions of the example diverge insignificantly from those of the process flow chart because the example was carried out on a comparatively small scale.

In density separation, a mixture consisting of solid particles of differing densities with a narrow grain fraction are suspended in a liquid or gas flow, and out of this suspension particles having the same density fall out in about the same place. In electrostatic separation, particles of differing electrical conductivity are separated by the force of an electric field. All percentages stating the composition of materials and indicated by the symbol "%", are weight percentages. The ratios which describe the composition of mixtures of materials are weight ratios.

It will be understood that the above description of the present invention is susceptible to various modifications, changes and adaptations, and the same are intended to be comprehended within the meaning and range of equivalents of the appended claims.

What is claimed is:

1. Process for the production of ferromanganese with a carbon content of from 0.05 to 8% from iron-containing manganese ore by heating a mixture of manganese ore, solid carbon-containing fuel and slag-forming constituents in a rotary kiln, and subsequently melting, in a melting furnace, ferromanganese from the reaction product that is removed from the rotary kiln and cooled down, comprising:

(a) forming a mixture of manganese ore, coal and slag-forming constituents at an ore-coal ratio of 1:0:4 to 1:2, in which mixture slag-forming constituents CaO, MgO, $Al_2O_3$ and $SiO_2$ are present in an amount such that in the slag a $(CaO+MgO)/(Al_2O_3+SiO_2)$ ratio exists of 1:0:3 to 1:4 and the $Al_2O_3/SiO_2$ ratio is 1:0:3 to 1:9;

(b) heating the mixture in the rotary kiln from 20 to 240 minutes in a CO-containing atmosphere at a temperature of from 1200° to 1350° C. to form a reaction product and removing the reaction product from the rotary kiln;

(c) crushing the reaction product removed from the rotary kiln to a particle diameter of less than 15 mm;

(d) separating the crushed reaction product by density separation into a coal-containing fraction which is reintroduced into the rotary kiln, at least one metal-containing slag-rich fraction and an alloy fraction to be delivered to the melting furnace; and (e) delivering the alloy fraction to the melting furnace and melting the alloy fraction in the melting furnace at temperatures of from 1400° to 1600° C.

2. Process according to claim 1, wherein the mixture in step (a) is formed by mixing the coal and the ore, which contain slag-forming constituents, and by separately adding at least one slag-forming constituent of CaO, MgO, $Al_2O_3$ and $SiO_2$ in such an amount to produce said $(CaO+MgO)/(Al_2O_3+SiO_2)$ ratio and the said $Al_2O_3/SiO_2$.

3. Process according to claim 2, wherein $SiO_2$ is first added to the manganese ore-coal-slag-forming constituents mixture in the rotary kiln when the mixture has a temperature of more than 900° C.

4. Process according to claim 1, further comprising pulverizing each metal-containing slag-rich fraction to a particle diameter of less than 5 mm, and separating the so pulverized slag-rich fraction by density separation into a metal-poor slag fraction and an alloy fraction to be delivered to the melting furnace.

5. Process according to claim 4, further comprising grinding the metal-poor slag fraction to a particle size of less than 0.5 mm and separating the so ground metal-poor slag fraction, by density separation and/or electrostatic separation, into a slag fraction and an alloy fraction to be delivered to the melting furnace.

6. Process according to claim 5, comprising combining (i) the alloy fraction from step (d), (ii) the alloy fraction formed by separating the pulverized slag-rich fraction, and (iii) the alloy fraction formed by separating the ground metal-poor slag fraction to form an alloy fraction mixture, separating the alloy fraction mixture into a portion which has a particle diameter of less than 1 mm, and blowing this portion into the melt contained in the melting furnace.

7. Process according to claim 1, wherein the alloy fraction has a portion with a particle diameter of less than 1 mm, and further comprising blowing this portion into the melt contained in the melting furnace.

8. Process according to claim 7, further comprising suspending the portion of the alloy fraction with a particle diameter of less than 1 mm, as well as coal with a particle diameter of less than 1 mm, in a carrier gas and blowing the so suspended alloy fraction and coal into the melt through a first nozzle provided in the melting furnace under the metal bath surface, while blowing oxygen into the melt through a second nozzle coordinated with the first nozzle.

9. Process according to claim 8, wherein the alloy fraction-coal-carrier gas suspension is blown into the melt through the first nozzle which is in the form of an outer tube of a jacket nozzle provided in the melting furnace under the surface of the metal bath, and the oxygen is blown into the melt through the second nozzle which is in the form of an inner tube of the jacket nozzle.

10. Process according to claim 8, wherein 0.4 to 0.8 kg of coal and a stoichiometric quantity of oxygen corresponding to the quantity of coal are blown into the melt under the metal surface per kilogram of alloy fraction introduced into the melting furnace.

11. Process according to claim 8, further comprising using at least a part of the exhaust gas of the melting furnace as the carrier gas.

12. Process according to claim 11, further comprising using the heat of the exhaust gas from the melting furnace to carbonize the coal that is blown into the melt beneath the metal bath surface.

13. Process according to claim 12, further comprising burning in the rotary kiln exhaust gas from the melting furnace not used as carrier gas and the carbonization of the coal.

14. Process according to claim 1, wherein the exhaust gas from the rotary kiln is afterburned and using the heat content of the afterburned exhaust gas at least partially to preheat the manganese ore and the slag-forming constituents.

15. Process according to claim 1, wherein the melt is intermittently refined as well as desulfurized by blowing in oxygen as well as by the introduction of CaO and/or $CaC_2$.

16. Process according to claim 1, further comprising obtaining a melted slag in the melting furnace, cooling the melted slag to obtain a granulated material and mixing the so obtained granulated material with the metal-containing slag-rich fraction.

17. Process according to claim 16, further comprising pulverizing the mixture, obtained from mixing the granulated material with the slag-rich fractions, to a particle diameter of less than 5 mm, and separating the so pulverized mixture by density separation into a metal-poor slag fraction and an alloy fraction to be delivered to a melting furnace.

18. Process according to claim 1, wherein the mixture in step (a) is formed by mixing the coal and the ore, and wherein the ore and coal contain the slag-forming constituents in an amount which produces the said $(CaO+MgO)/(Al_2O_3+SiO_2)$ ratio and the $Al_2O_3/SiO_2$ ratio.

19. Process according to claim 1, wherein the mixture of manganese ore, coal and slag-forming constituents is heated in the rotary kiln for a period of from 20 to 120 minutes at temperatures of from 1250° to 1330° C., and the melting of the alloy fraction is conducted at temperatures of from 1450° to 1550° C.

20. Process according to claim 1, wherein in the manganese ore-coal-slag-forming constituents mixture, the manganese ore has a particle size of under 5 mm, the coal has a particle diameter of under 15 mm, and the slag-forming constituents have a particle diameter of under 5 mm.

* * * * *